United States Patent [19]

Beltran et al.

[11] 4,144,380

[45] Mar. 13, 1979

[54] CLADDINGS OF HIGH-TEMPERATURE AUSTENITIC ALLOYS FOR USE IN GAS TURBINE BUCKETS AND VANES

[75] Inventors: Adrian M. Beltran, Ballston Lake; William F. Schilling, Schenectady, both of N.Y.

[73] Assignee: General Electric Company, Schenectady, N.Y.

[21] Appl. No.: 823,229

[22] Filed: Aug. 10, 1977

Related U.S. Application Data

[63] Continuation of Ser. No. 692,512, Jun. 3, 1976, abandoned.

[51] Int. Cl.[2] ..... B32B 15/18

[52] U.S. Cl. ..... 428/679; 75/122; 75/124; 75/134 F; 75/171; 148/31

[58] Field of Search ..... 75/122, 134 F, 124, 75/171, 128 B, 128 E; 148/31.5, 31, 38, 39; 428/679

[56] References Cited

U.S. PATENT DOCUMENTS

| | | | |
|---|---|---|---|
| 3,017,265 | 1/1962 | McGurty | 75/122 |
| 3,027,252 | 3/1962 | McGurty | 75/126 G |
| 3,420,660 | 1/1969 | Kawahata et al. | 75/122 |
| 3,619,180 | 11/1971 | Staehle et al. | 75/128 R |
| 3,649,225 | 3/1972 | Simmons, Jr. | 428/651 |
| 3,754,898 | 8/1973 | McGurty | 75/122 |
| 4,005,989 | 2/1977 | Preston | 75/171 |
| 4,034,142 | 7/1977 | Hecht | 428/678 |

*Primary Examiner*—Arthur J. Steiner

*Attorney, Agent, or Firm*—John F. Ahern; James W. Mitchell

[57] ABSTRACT

Austenitic alloys are disclosed which consist of iron, nickel, cobalt, chromium, aluminum, and yttrium, and articles utilizing these alloys are described such as claddings for gas turbine buckets. The substitution of selected quantities of nickel or nickel and cobalt in prior art ferrous alloys, together with the use of rather high levels of chromium, yields articles having excellent high-temperature strength, oxidation and hot corrosion resistance, and diffusion and thermal expansion compatibility with superalloy substrates.

11 Claims, No Drawings

CLADDINGS OF HIGH-TEMPERATURE AUSTENITIC ALLOYS FOR USE IN GAS TURBINE BUCKETS AND VANES

BACKGROUND OF THE INVENTION

This invention was made under contract with the United States Government, Maritime Administration of the Department of Commerce, Contract 0-35510. The U.S. Government is licensed in accordance with the terms of the aforesaid contract and has reserved the rights set forth in Sections 1(f) and 1(9) of the Oct. 10, 1963 Presidential Statement of Government Patent Policy.

CROSS-REFERENCE TO RELATED APPLICATION

This is a continuation-in-part of U.S. application Ser. No. 692,512, filed June 3, 1976, now abandoned.

The present invention relates to a new series of iron-base alloy composition having greatly improved high-temperature strength with concurrently high hot corrosion-oxidation resistance. These new modified iron-base alloys are readily adaptable to uses such as sheet claddings, nozzle vanes, combustion can liners, resistance heating elements, and other high-temperature applications.

The use of sheet metal cladding on bucket airfoils is now recognized as a viable technique for improving the surface stability of alloys used in hot gas path turbine components. Several limitations are imposed on the choice of a particular alloy for the cladding function. For example, the alloy should possess:

a. Low interdiffusion rates between cladding and substrate because this affects the useful life of the cladding.

b. There should be close matching up of coefficients of thermal expansion between cladding and substrate to minimize thermal stresses and failure by shear along the cladding and substrate interface.

c. It is also desirable to have maximum high-temperature strength and ductility commensurate with a and b, to withstand thermal and mechanical loads in service.

One of the materials currently under consideration as a potential cladding is an alloy composed of iron, chromium, aluminum, and ytrrium. This alloy is basically a ferritic body centered cubic (bcc) solid solution alloy with a dispersion complex of yttrium and iron (Y Feg). While the alloy shows superior hot corrosion/oxidation resistance, its crystal structure limits its usefulness as a cladding alloy. For example, due to its more open atomic arrangement, the (bcc) structure exhibits higher diffusion rates and lower coefficients of thermal expansion, differing perhaps by more than 10% from those of the nickel-base alloy substrates which possess the close-packed face centered cubic (fcc) structure. The higher diffusivity through the (bcc) structure is directly reflected in the notoriously poor high-temperature creep resistance of these alloys.

BRIEF DESCRIPTION OF THE INVENTION

In accordance with this invention, it has been found that with respect to the criteria outlined above significant improvements can be obtained by modifying the crystal structure of the body centered cubic (bcc) chromium, aluminum, yttrium, iron alloys to face centered cubic (fcc).

Very little literature is presently available on the iron, nickel, cobalt, chromium, aluminum, yttrium alloys. In brief, this invention relates to a series of stable, austenitic (fcc) iron, chromium, aluminum, yttrium alloys to which have been added nickel, or nickel and cobalt. These modified alloys exhibit lower diffusivities, better coefficient of thermal expansion matching with nickel-base alloys, and increased high-temperature strength while, at the same time, maintaining the outstanding hot corrosion/oxidation resistance associated with iron, chromium, aluminum type alloys.

DETAILED DESCRIPTION OF THE INVENTION

The modified alloys of this invention have the following weight percent compositions:

| | |
|---|---|
| Chromium | 15–35 |
| Nickel | 5–35 |
| Cobalt | 0–15 |
| Aluminum | 3–6 |
| Yttrium | 0.1–1.5 |
| Iron | Balance |

Chromium and aluminum control the high-temperature oxidation and hot corrosion resistance of the modified alloys. In sulfidation (hot corrosion) atmospheres between 1600 and 1800° F, such as those produced in marine environments by the ingestion of sea salt into a gas turbine, chromium levels must equal or exceed 25 weight percent and Al levels should be in the range of 3.0 to 4.5% to provide effective resistance. For use in sulfidizing atmospheres, cobalt should be substituted for some of the nickel to enhance resistance.

Thus in a preferred embodiment of the invention wherein these alloys are used as claddings on gas turbine hardware such as turbine buckets which may be subject to hot corrosion, the claddings are provided with chromium levels of 25–35 weight percent and cobalt levels of up to 15 weight percent.

In the absence of sulfidation atmospheres, aluminum forms a more protective oxide than chromium ($Al_2O_3$ versus $Cr_2O_3$); hence in such atmospheres the aluminum content should be increased and the chromium content reduced within the above ranges. Above 1800° F, $Al_2O_3$ is a more stable oxide than $Cr_2O_3$, due to volatilization of $CrO_3$.

Yttrium is added to the modified alloys to improve scale adherence. However, since yttrium and nickel combine to form a lower temperature pseudo-eutectic than yttrium and iron, which reduces the high-temperature strength of the alloy, the yttrium content should be decreased as the nickel is increased. For example, the following Ni/Y trade off is within the scope of this invention:

| % Ni | % Y |
|---|---|
| 15 | 1.5 |
| 20 | 0.6 |
| 25 | 0.3 |
| 30 | 0.2 |
| 35 | 0.1 |

Table I shows the effect of nickel and cobalt additions on the crystal structure of chromium, aluminum, yttrium iron alloys.

TABLE I

| Alloy | Cr | Ni | Co | Al | Y | Fe | Austenite Content As Cast % | Austenite Content Heat Treated % |
|---|---|---|---|---|---|---|---|---|
| FeCrAlY | 25 | .0 | 0 | 4 | 1 | bal | 0 | 0 |
| BS-2 | 25 | 30 | 0 | 4 | 1 | bal | 93 | 100 |
| BS-3 | 25 | 15 | 15 | 4 | 1 | bal | 66.6 | 100 |
| BS-4 | 25 | 0 | 30 | 4 | 1 | bal | 0 | 0 |
| BS-5 | 25 | 35 | 0 | 4 | .15 | bal | 93 | 100 |

The austenite content (percent of the alloy which has an (fcc) structure) was determined by x-ray diffraction analysis of ascast bars and solution quenched bars (solution heat treated at 2200° F for 30 minutes, followed by an oil quench).

It will be seen that the addition of nickel gives the (fcc) structure, and that cobalt may be substituted for some but not all of the nickel.

While solution heat treatment of the alloys shown in Table I was at 2200° F for 30 minutes, temperatures between 1800° F and 2350° F and times between 30 minutes and 8 hours can be used with these alloys depending upon size, thickness, and/or shape of article.

A major problem in the diffusion bonding of an iron, chromium, aluminum, yttrium alloy to a nickel-base substrate, such as IN-738, is that in subsequent high-temperature exposure (1600 to 2000° F), as in gas turbine service conditions, iron diffuses from the cladding into the substrate. The depth of diffusion into the substrate increases with time and temperature. The presence of iron in IN-738 promotes the precipitation of the intermetallic sigma phase, which severely degrades the mechanical properties of the substrate. Since the driving force for diffusion is the compositional gradient across the cladding/substrate bond line, substituting nickel and cobalt for iron in the cladding reduces the iron gradient.

Thus, as exemplified by the preferred claddings of the present invention designated as BS-2, BS-3, and BS-5 in Table I, it is advantageous from the standpoint of reducing iron gradient that the nickel plus cobalt content of the claddings be 30 percent by weight or greater so that total iron content of the cladding is limited to about 40 percent as contrasted with the 70 percent iron content of the prior art FeCrAlY.

Specimens for evaluating iron diffusion were prepared by hot isostatic press (HIP) diffusion bonding 10-mil thick sheet cladding to 0.062 inch thick by 1 inch diameter discs of IN-738 substrate and exposing the specimens in the gas turbine simulator apparatus described with respect to the data of Table III. Table II shows that the depth of iron diffusion into IN-738 substrate is reduced by approximately one half by substituting nickel for iron as in Table I.

TABLE II

| Alloy | Diffusion of Iron into IN-738 Substrate 1600° F/1000 hr. | 1800° F/1000 hr. |
|---|---|---|
| FeCrAlY | 41 μ | 71 μ |
| BS-5 | 18 μ | 41 μ |

Table III shows that the addition of nickel to the Fe, Cr, Al, Y alloys has no adverse effect on the hot corrosion resistance of the cladding on IN-738. The specimens were exposed in a gas turbine simulator apparatus to combusted diesel oil containing 1% S and doped with 8 ppm Na at a 50:1 air:fuel ratio. Sea salt is prepared in accordance with ASTM D665-60 and mixed with the diesel oil to produce a level of 8 ppm Na in the combustion products. The specimens were thermal cycled by air blasting to nearly room temperature an average of every 50 hours to simulate gas turbine shutdown and to test the adherence of the protective scale. After the times indicated the surface loss and the maximum oxide/penetration of the cladding were measured metallographically in mils per surface.

TABLE III

| Alloy | Fuel | Temp. °F | Time-Hrs. | Maximum Penetration Mils | Surface Loss Mils |
|---|---|---|---|---|---|
| FeCrAlY | Diesel Oil & Sea Salt | 1600 | 1039 | 1.3 | 0.0 |
| | | 1600 | 3077 | 2.2 | 1.1 |
| | | 1800 | 985 | 3.7 | 1.7 |
| BS-5 | Diesel Oil & Sea Salt | 1600 | 1012 | 1.7 | 0.4 |
| | | 1600 | 1902 | 1.7 | 0.1 |
| | | 1800 | 1014 | 1.9 | 0.3 |

Some additional high-temperature burner rig data were also generated. Undoped propane was combusted in a simulated gas turbine burner apparatus, producing a highly oxidizing environment. As before, disc-shaped specimens (0.062 inch thick, 1 inch diameter) were thermal cycled by air-blasting to near room-temperature an average of every 50 hours. The metallographic measurements taken at 100 times magnification show BS-5 superior to the reference alloy at 1800° F and essentially equivalent at 1900° F for exposures in excess of 10,000 hours. (The interpolated data for FeCrAlY at 1800° F/11,000 hours would be 4.4 mils maximum penetration and 0.7 mil surface loss.) These data are shown in Table IV.

TABLE IV

| Alloy | Fuel | Temp. °F | Time-Hrs. | Maximum Penetration Mils | Surface Loss Mils |
|---|---|---|---|---|---|
| FeCrAlY | Propane | 1800 | 5,004 | 1.9 | 0.4 |
| FeCrAlY | Propane | 1800 | 15,437 | 5.7 | 0.9 |
| BS-5 | Propane | 1800 | 11,465 | 0.8 | 0.0 |
| FeCrAlY | Propane | 1900 | 11,694 | 3.8 | 0.4 |
| BS-5 | Propane | 1900 | 13,045 | 2.5 | 1.2 |

The data in Table V show that the expansion coefficient $\alpha$ of the FeCrAlY alloy differs from that of IN-738 by −9.8%, while with BS-5/IN-738 the difference is only +3.1%. The lower thermal expansion mismatch with BS-5 produces lower thermal stresses at the cladding/substrate interface.

TABLE V

| Alloy | $\alpha \times 10^{-6}$ in./in./° F (100–1830° F) |
|---|---|
| FeCrAlY | 8.51 |
| BS-5 | 9.72 |
| IN-738 | 9.43 |

The results of tensile tests on FeCrAlY and nickel modified alloys are presented in Table VI. The test specimens were argon-atomized, pre-alloyed powder consolidated to rod shape by: (1) hot isostatic pressing (HIP) at 2200° F/15 ksi/2 hours, or (2) hot extrusion (EXT) at 1800° F and 16:1 extrusion ratio. Before testing the nickel modified material was solution-quenched in water following a 2000° F/30-minute heat treatment.

At room temperature the nickel modified alloy has a higher tensile strength (UTS) but a lower 0.2% yield strength (0.2% YS) than the FeCrAlY alloy with essentially equivalent ductility, i.e., percent elongations (% El) and percent reduction in area (% R.A.). At 1800° F, however, the nickel modified alloy is five times stronger than the FeCrAlY alloy with acceptable ductility. This high temperature strength advantage is useful for a wide variety of high-temperature applications such as combustion can liners, resistance heating elements and nozzle vanes.

TABLE VI

| Alloy | Composition, Wt. % Fe | Ni | Cr | Al | Y | Form | (a) Powder Mesh Fraction | Test Temp. °F | 0.2% Y.S. (Ksi) | UTS (Ksi) | Elongation % | (b) R.A. % |
|---|---|---|---|---|---|---|---|---|---|---|---|---|
| FeCrAlY | Bal. | — | 25.0 | 5.5 | 0.2 | HIP | −60 | RT | 69.8 | 101.6 | 23.0 | 56.0 |
| FeCrAlY | Bal. | — | 25.0 | 5.5 | 0.2 | HIP | −100 | RT | 72.1 | 104.2 | 24.4 | 56.0 |
| FeCrAlY | Bal. | — | 25.0 | 4.0 | 1.0 | EXT. | −60 | 1800 | 0.6 | 2.5 | 166 | 96.0 |
| Nickel Modified | Bal. | 35 | 25.0 | 5.5 | 0.2 | HIP | −100 | RT | 55.7 | 129.8 | 24.7 | 34.3 |
| Nickel Modified | Bal. | 35 | 25.0 | 5.5 | 0.2 | HIP | −100 | 1800 | 3.0 | 11.8 | 42.3 | 35.0 |

(a) Tyler Standard Sieve Series
(b) Reduction of Area

The conversion of the (bcc) matrix crystal structure of FeCrAlY alloys to a (fcc) structure by adding nickel or nickel and cobalt gives the following beneficial characteristics:

(1) A significant strength advantage at high temperatures.

(2) A lower thermal expansion coefficient mismatch between a sheet cladding and a nickel-base superalloy substrate.

(3) Lower interdiffusion rates between cladding and substrate, i.e., Fe into IN-738.

(4) Superior oxidation and hot corrosion resistance.

As mentioned hereinbefore, while alloys as described hereinbefore have many uses, the application for which they were developed, and the environment in which their primary use lies is in combination with certain high-temperature alloys in highly corrosive environments such as is encountered in the gas path of a gas turbine.

Thus our invention encompasses the combination of such high-temperature alloys as structural components of a gas turbine or like device wherein a high-temperature cobalt-base or nickel-base superalloy core member constitutes the structural member having the requisite strength to perform its function and the (fcc) austenitic alloys described hereinbefore provide corrosion-resistant protection for the superalloy core member by virtue of its high resistance to diffusion and other corrosion mechanisms.

In such combinations, the superalloy is susceptible to corrosion in certain environments and needs the protection of the high-temperature austenitic (fcc) corrosion-resistant alloy. On the other hand the superalloy provides the necessary structural strength to support the corrosion-resistant alloy on the superalloy substrate. Finally since the thermal expansion coefficients of the two are closely matched, the combination provides a unique marriage of the characteristics of both which utilizes the best of each alloy to advantage in a unique combination.

The superalloys we use as structural members, such as gas turbine buckets and guide vanes, are nickel- or cobalt-base alloys having in excess of 50% by weight of nickel or cobalt, no ferrous constituents, and having significant proportions of chromium, aluminum, titanium, carbon, tantalum and molybdenum or tungsten. Some such alloys include René 77, René 80, René/IN-100; B1900; Udimet 500; INCO 713C; IN-738; IN-792; MAR-M-200; MAR-M-246; FSX-414; X-40 and MM-509.

While specific examples have been set forth in describing preferred embodiments of the invention, it is understood that various modifications may be made therein by those skilled in the cladding art. It is intended by the appended claims to claim all such modifications relating to gas turbine claddings and clad articles which fall within the true spirit and scope of this invention.

What is claimed is:

1. A cladding for use on gas turbine buckets or gas turbine vanes subject to high-temperature corrosive atmospheres, said cladding consisting essentially of, by weight, 25–35 percent chromium, 15–35 percent nickel, 0–15 percent cobalt, 3–6 percent aluminum, 0.1–1.5 percent yttrium, balance iron, said cladding having a crystal structure at least 66 percent face centered cubic and a nickel plus cobalt content of at least 30 percent by weight.

2. A cladding according to claim 1 consisting essentially of by weight about 25 percent chromium, 15 percent nickel, 15 percent cobalt, 4 percent aluminum, 1 percent yttrium, balance iron.

3. a cladding according to claim 1 consisting essentially of by weight about 25 percent chromium, 30 percent nickel, 4 percent aluminum, 1.0 percent yttrium, balance iron.

4. A cladding according to claim 1 consisting essentially of by weight about 25 percent chromium, 35 percent nickel, 4 percent aluminum, 0.15 percent yttrium, balance iron.

5. A cladding according to claim 1 which, on solution heat treating at 1800° F to 2350° F for 30 minutes to eight hours followed by quenching, is characterized by a crystal structure substantially 100 percent face centered cubic.

6. A cladding according to claim 5 which, on solution heat treating at 2200° F for 30 minutes followed by quenching, is characterized by a crystal structure substantially 100 percent austenitic.

7. A gas turbine bucket or gas turbine vane comprising:

a core member of a superalloy having a major constituent selected from the group consisting of nickel and cobalt and further characterized by being essentially free of iron; and a cladding surrounding said core member, said cladding consisting essentially of, by weight, 25–35 percent chromium, 15–35 percent nickel, 0–15 percent cobalt, 3–6 percent aluminum, 0.1–1.5 percent yttrium, balance iron, said cladding having a crystal structure at least 66 percent face centered cubic.

8. The article of claim 7 wherein said cladding consists essentially of, by weight, about 25 percent chromium, 15 percent nickel, 15 percent cobalt, 4 percent aluminum, 1 percent yttrium, balance iron.

9. The article of claim 7 wherein said cladding consists essentially of, by weight, about 25 percent chromium, 35 percent nickel, 4 percent aluminum, 0.15 percent yttrium, balance iron.

10. The article of claim 7 wherein said cladding has a crystal structure substantially 100 percent face centered cubic.

11. The article of claim 7 wherein said core member and said cladding have closely matching coefficients of thermal expansion to minimize shear stress at the bond interface therebetween.

* * * * *